United States Patent [19]

Firey

[11] Patent Number: 4,480,654

[45] Date of Patent: Nov. 6, 1984

[54] MULTIPRESSURE COMPRESSOR

[76] Inventor: Joseph C. Firey, P.O. Box 15514, Seattle, Wash. 98115

[21] Appl. No.: 411,913

[22] Filed: Aug. 26, 1982

[51] Int. Cl.[3] ..... G05D 11/00

[52] U.S. Cl. ..... 137/119; 417/442

[58] Field of Search ..... 417/295, 302, 303, 308, 417/442; 137/119, 121

[56] References Cited

U.S. PATENT DOCUMENTS 2,968,317 1/1961 Jay ..... 137/119 X 3,807,422 4/1974 McJones ..... 137/119 X

FOREIGN PATENT DOCUMENTS 2404722 8/1974 Fed. Rep. of Germany ..... 417/442

*Primary Examiner*—Richard E. Gluck

[57] ABSTRACT

A multipressure compressor machine is described capable of delivering gas or vapor at several different discharge pressures from a single compressor which may be using suction gas or vapor also at several different pressures.

17 Claims, 9 Drawing Figures

MULTIPRESSURE COMPRESSOR

CROSS REFERENCES TO RELATED APPLICATIONS

This application is somewhat related to my earlier filed U.S. patent application entitled, "Cyclic Catalytic Reactor," Ser. No. 06/214443, filing date Dec. 8, 1980, Joseph C. Firey inventor; now abandoned, but the individual elements, the combination of elements, the functions performed, and the beneficial results achieved are all different.

BACKGROUND OF THE INVENTION

1. Field of the Invention

This invention is in the field of compressors of gases and vapors and particularly such compressors for use at several different pressures.

2. Description of the Prior Art

Prior art gas and vapor compressor systems, used to deliver several different discharge pressures, have used a separate compressor for each discharge pressure. For example, a factory using air motor driven tools together with pneumatic actuators or work positioners will usually prefer medium discharge pressures for the air motors and high discharge pressures for the actuators and positioners and two or more separate compressors would be required with prior art methods. When prior art gas and vapor compressor systems are used to pump from several different suction pressures, a separate compressor is used for each suction pressure. For example, a vapor compression refrigeration plant used to maintain several different temperatures, and hence refrigerant pressures, in several different food storage rooms will require a separate compressor for each different suction pressure and temperature. These prior art multicompressor gas and vapor compressor systems are thus costly since the individual compressors are one of the most expensive components in the system.

In some prior art gas and vapor compressor systems, all fluid is compressed by a single compressor to the highest working discharge pressure and then portions are throttled to lower working pressures to yield several different discharge pressures. Alternatively, where several different suction pressures are used, all gas and vapor can be throttled to the lowest suction pressure used and then all gas and vapor are pumped from this lowest suction pressure by a single compressor. But these prior art throttling methods for utilizing a single compressor to work at several different pressures suffer the disadvantage of requiring a greater power input to the compressor and thus an increased energy consumption and operating cost.

Where a single very high discharge pressure is used with a single low suction pressure, a single multistage compressor is commonly used in the prior art. These multistage compressors are also costly as requiring a separate piston and cylinder or rotor for each stage and can be considered as equivalent to a number of separate compressors with a common drive means and interconnected discharge and suction between stages. These prior art multistage compressors are frequently unsuitable for use where gases and vapors are to be withdrawn at intermediate pressures or are to be added in at intermediate pressures since the gas pumping capacity of each stage is changed thereby and, in consequence, some of the various pressures are also changed.

Herein the term compressor includes all of the several kinds of gas and vapor compressors, such as: piston and cylinder compressors; Roots type compressors; turbo compressors, etc. All compressors have a suction, or inlet, where the gas or vapor to be compressed enters the compressor, and a discharge, or outlet, where the compressed gas or vapor leaves the compressor. Herein the term compressor drive means includes all of the several means for driving compressors, such as: electric motors; steam turbines, gas turbines; internal combustion engines, etc.

It is a common, though not universal, practice to use a holding tank for each operating pressure of a compressor system. Where such holding tanks receive compressed gas or vapor from the compressor discharge, they are herein referred to as receivers. Where such holding tanks supply gas or vapor to the compressor suction, they are herein referred to as sources. In some cases, as for example intermediate pressure holding tanks for a multistage compressor, a single tank may function as a receiver and a source.

SUMMARY OF THE INVENTION

A machine of this invention can deliver at discharge compressed gas or vapor at several different pressures from a single compressor, and a single compressor of this invention can use gas or vapor supplied at suction at several different pressures. In addition to the compressor and its drive, at least one selector valve is used, either on the compressor discharge or on the compressor suction or on both, and this selector valve is driven through a sequence of connectings by a drive means actuated by a control means responsive to the pressure at the connected selector valve port. In this way, the compressor is operated for a period of time at each of the desired pressures. Thus, a single compressor of this invention can achieve results requiring several compressors when prior art methods are used and thus a cost savings results. Some forms of this invention also use a compressor shut-off means which reduces compressor capacity to zero for a portion of the operating time, and this time portion can be adjusted by the shut-off control means so that compressor delivery rate equals gas or vapor utilization rate.

BRIEF DESCRIPTION OF THE DRAWINGS

An example multipressure compressor, 1, is shown schematically in FIG. 1 as fitted with a discharge selector valve, 3, and suction selector valve, 5.

One type of rotary selector valve is shown in FIG. 2.

Figure 3:
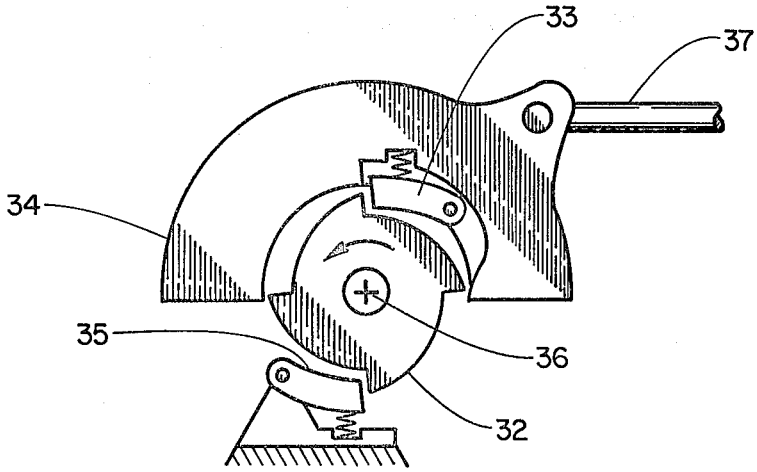
Figure 4:
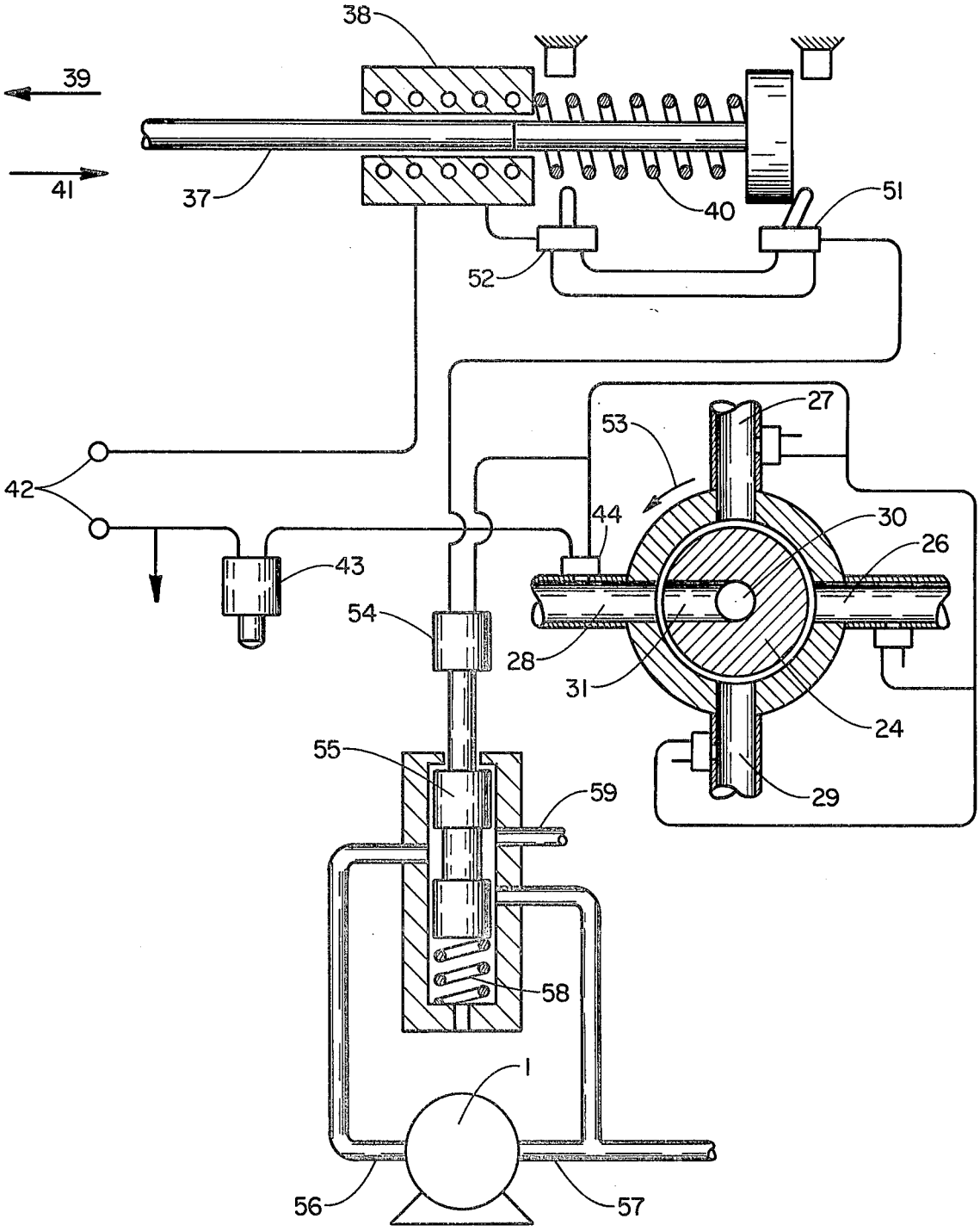
Figure 5:
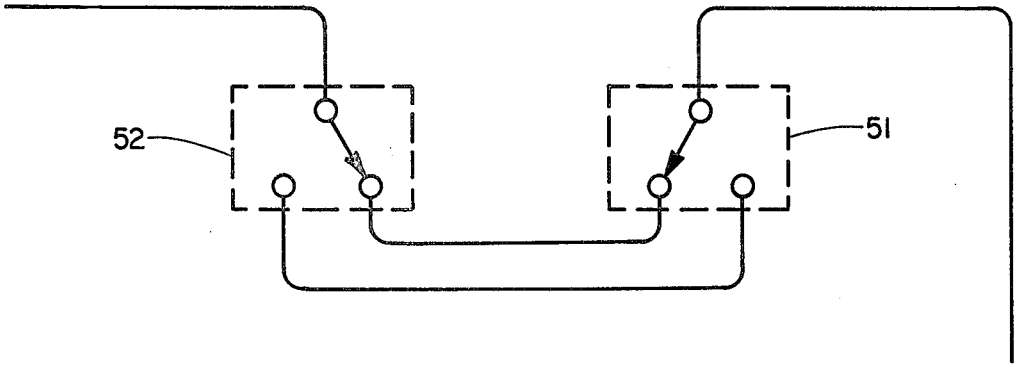
Figure 6:
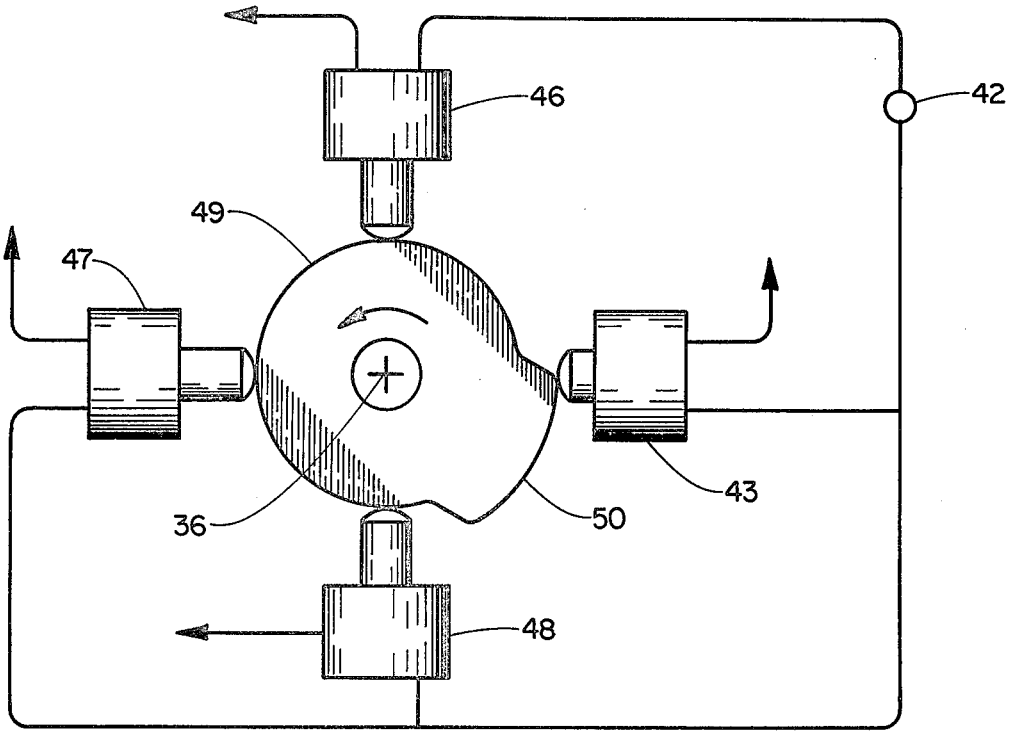

A selector valve drive means is shown in FIGS. 3 and 4 with a control means therefor shown in FIGS. 4, 5, and 6.

Figure 7:
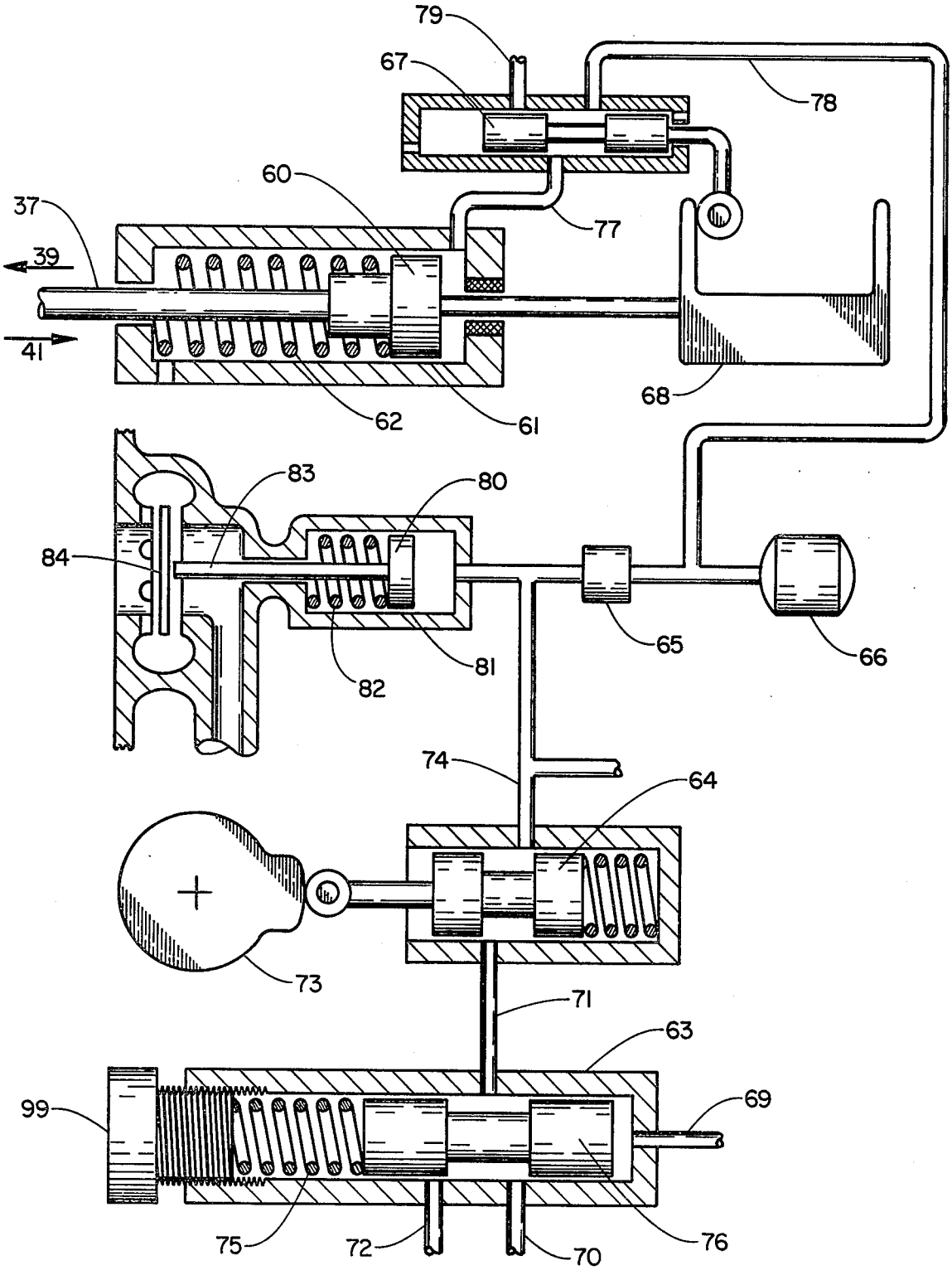

A pneumatic selector valve drive means and control means is shown partially in FIG. 7, including a compressor shut-off means.

Figure 8:
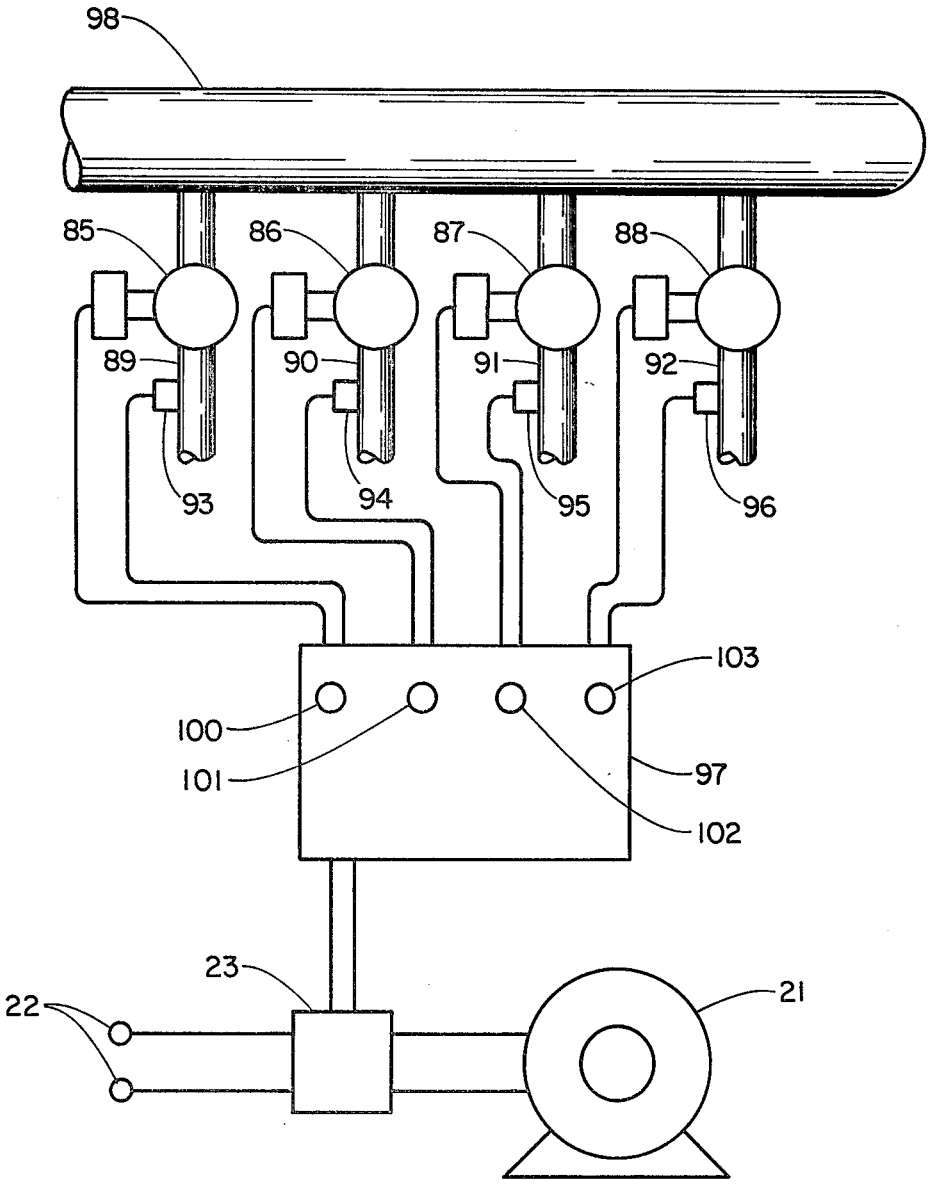

An electrical and electronic selector valve drive means and control means and compressor shut-off means is shown schematically in FIG. 8.

Figure 9:
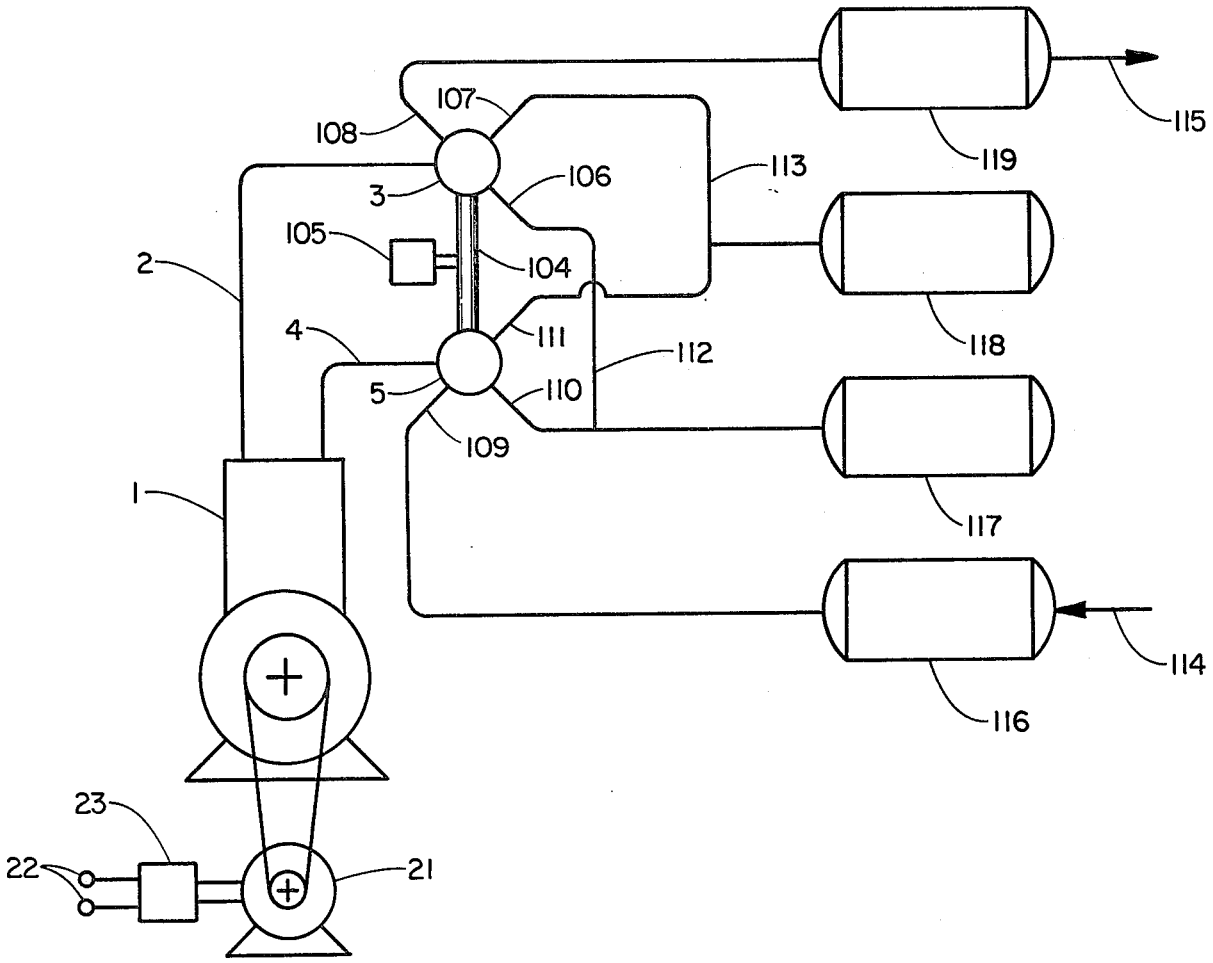

A cascade form of this invention is shown in FIG. 9 with a common selector valve drive means, 104, and control means therefor, 105, being used to simultaneously drive both a discharge selector valve, 3, and a suction selector valve, 5.

DESCRIPTION OF THE PREFERRED EMBODIMENTS

A single multipressure compressor of this invention is capable of supplying compressed gases or vapors at several different discharge pressures concurrently, and can also operate efficiently when supplied with gases or vapors at several different suction pressures. With prior art compressor schemes, a separate compressor is used for each discharge pressure and suction pressure combination being utilized. It is thus a principal beneficial object of this invention that a single compressor can serve where several prior art compressors were needed and a cost savings results.

A multipressure compressor of this invention comprises the following elements:

1. A gas or vapor compressor, such as those described hereinabove, or other type.
2. A drive means for driving the compressor, such as those described hereinabove, or other type.
3. At least one multiported selector valve in the compressor discharge pipe, or in the compressor suction pipe, or two such selector valves, one in the discharge pipe and one in the suction pipe. Each such discharge selector valve has at least two discharge ports and at least one moving element which can connect between the inlet port to the compressor discharge pipe and these discharge ports, one port at a time. Each such suction selector valve has at least two suction ports and at least one moving element which can connect between the inlet port to the compressor suction pipe and these suction ports, one port at a time. Various types of selector valves can be used as for example; rotary valves, sliding valves, poppett valves, a set of ganged valves with multiple moving elements in each selector valve, etc. The number of discharge ports in a discharge selector valve should at least equal the number of different desired discharge pressures of the gas or vapor being compressed. The number of suction ports in a suction selector valve should at least equal the number of different desired suction pressures of the gas or vapor being compressed.
4. At least one drive means for driving the selector valve moving elements through a sequence of connectings between the inlet port connected to the compressor pipe and the selector valve ports, one port at a time for any one selector valve. Each discharge port is connected at least once, and preferably only once, during each discharge sequence of connectings. Each suction port is connected at least once, and preferably only once, during each suction sequence of connectings. Preferably, the compressor suction and discharge pipes are always connected to some suction and discharge port respectively. A single drive means can be used to drive both the discharge selector valve moving element and the suction selector valve moving element. Alternatively, each selector valve moving element can be driven by its own separate drive means. The time ordered sequence of connectings made between the discharge selector valve inlet port and the discharge ports by the moving element of the discharge selector valve is termed the discharge sequence of connectings. The time ordered sequence of connectings made between the suction selector valve inlet port and the suction ports by the moving element of the suction selector valve is termed the suction sequence of connectings. Commonly the sequence of connectings will be fixed and preset by the arrangement of the discharge or suction ports on the selector valve relative to the design and direction of motion of the moving elements of the selector valve, and the design of the drive means. However, it is possible to design selector valves and drive means whose sequence of connectings can be changed, if desired, from one sequence to a different one. Various types of selector valve drive means can be used such as: solenoid and spring or pneumatic piston and spring actuators to rotate a selector valve shaft through the arc between ports in the sequence; mechanical cam and spring actuators driven from the compressor shaft via an engageable and disengageable cam follower to rotate a selector valve shaft through the arc between ports in the sequence; multiple solenoid and spring actuators to open and close a set of ganged port valves, etc. In all cases, the selector valve drive means operates intermittently to drive the selector valve moving element rather quickly from one port on to the next port in the sequence and then leave the moving element stationary and connected at that next port until the pressure at that next port has changed to the value set for that port. When the set value of pressure for a connected port is reached a control means, as described hereinafter, operates to initiate the drive means to drive the selector valve moving element on to connect to the next port in the sequence and to disconnect from the previous port.
5. A pressure sensor and comparator at each discharge selector valve discharge port and at each suction selector valve suction port, to sense the pressure at the port and to compare the sensed pressure against a set value of pressure for that port. Pressure switches, or spring, piston, and port pneumatic valves are examples of suitable pressure sensors and comparators, the set value being set into the spring element. In some cases, it may be desired that the set value of pressure be adjustable. For discharge ports, the sensor and comparator will signal when the port pressure exceeds a set value of maximum pressure for that port. For suction ports, the sensor and comparator will signal when the port pressure becomes less than a set value of minimum pressure for that port.
6. A control means receiving as input a signal from that pressure sensor at the connected port when sensed pressure equals set pressure for that port and generating as resultant output an initiating signal to the drive means to drive the selector valve moving element on to connect to the next port in the sequence, and to disconnect from that port whose pressure has reached the set value. When one full sequence of connectings is completed, the control means signals to start a new sequence and thus the sequence is repeated continuously whenever the compressor is running. Various kinds of control means can be used such as; electrical, electronic, pneumatic, mechanical, combination, etc.

A multipressure compressor of this invention which utilized the elements listed by number above could operate satisfactorily in those applications where the net rate of use of discharge gas or vapor equalled the full compressor capacity and where the net rate of supply of suction gas or vapor equalled the full compressor capacity. In some compressor applications, however, either the net rate of use of discharge gas or vapor, or the net rate of supply of suction gas or vapor, or both vary over time and only occasionally will equal the full compressor capacity, being at other times less than the full compressor capacity. For these latter applications of variable through flow rate, a dual operating mode scheme is used in this invention to adjust actual compressor capacity to equal net gas or vapor flow rate desired for the application. In this dual operating mode scheme, the compressor operates either at full capacity in one mode or at essentially zero capacity in the other mode, and the net actual compressor capacity is adjusted to equal the net flow rate desired by adjusting the relative proportion of the operating times at full capacity and at zero capacity. For this dual operating mode scheme the additional elements comprise; a shut-off means for shutting off the compressor capacity to essentially zero, and a shut-off control means to adjust the proportion of compressor operating time which is at zero capacity in response to the actual net flow rate of gas or vapor desired for the application with the zero capacity time fractional portion decreasing as net flow rate increases. Various kinds of compressor capacity shut off means can be used as, for example: stopping the compressor drive; holding the compressor suction valve, if used, open; holding the compressor discharge valve, if used, closed; bypassing the compressor discharge back to the compressor suction via a bypass valve; etc. Preferably, the shut-off control means responds to the pressure sensor and comparator at the connected selector valve port and, when sensed pressure equals the set value of pressure for that port, operates the shut-off means to shut off the compressor capacity to zero. Various types of control means can be used as, for example, electrical, pneumatic, electronic, hydraulic, mechanical, combination, etc. Where only a discharge selector valve is used, the shut-off control means will operate the shut-off means which shuts off compressor capacity when the connected discharge port pressure equals or exceeds the set value of maximum pressure for that port. Where only a suction selector valve is used, the shut-off control means will operate the shut-off means which shuts off compressor capacity when the connected suction port pressure equals or is less than the set value of minimum pressure for that port. Where both a discharge selector valve and a suction selector valve are used, one of the following three schemes can be used:

a. the shut-off control means operates the shut-off means and shuts off compressor capacity whenever the connected discharge port pressure equals or exceeds the set value of maximum pressure for that discharge port;
b. The shut-off control means operates the shut-off means which shuts off compressor capacity whenever the connected suction port pressure equals or is less than the set value of minimum pressure for that suction port;
c. the shut-off control means operates the shut-off means which shuts off compressor capacity whenever the connected discharge port pressure equals or exceeds the set value of maximum pressure for that discharge port, and also whenever the connected suction port pressure equals or is less than the set value of minimum pressure for that suction port.

Where a single common drive means is used to drive both the discharge selector valve and the suction selector valve, the shut-off control means needs to be responsive to the same pressure sensors and comparators as is the selector valve drive control means. This latter responsiveness requirement avoids the possibility of shutting off the compressor before the drive means can be actuated and thus preventing the continuation of the sequence of connectings.

When operating, a multipressure compressor of this invention, which has only a discharge selector valve, compresses gas or vapor into the connected discharge port until the pressure at that port reaches the set value whereupon the pressure sensor and comparator at that port signals the control means which, in turn, signals the discharge selector valve drive means which then drives the discharge selector valve on to connect to the next discharge port in the discharge sequence and this next discharge port is similarly compressed up to its set value of discharge pressure. In this way, the pressure at each discharge port is brought up to its set value once during each discharge sequence of connectings and the sequence is continually repeated while the compressor is operating. In a similar manner, a multipressure compressor of this invention, which has only a suction selector valve, pumps down the pressure at each suction port to its set value once during each suction sequence of connectings. Also in a similar manner, a multipressure compressor of this invention, which has both a discharge selector valve and a suction selector valve with independent drive means and control means for each selector valve, pumps up the pressure at each discharge port to its set value once during each discharge sequence of connectings, and also pumps down the pressure at each suction port to its set value once during each suction sequence of connectings, but the discharge sequence and the suction sequence need not take place concurrently and may be of differing duration. A multipressure compressor of this invention, which has both a discharge selector valve and a suction selector valve with a single drive means and control means to drive both selector valves simultaneously, will pump up the pressure at each discharge port to its set value once during each sequence of connectings where the control means is responsive to pressure sensors at connected discharge ports, or will pump down the pressure at each suction port to its set value once during each sequence of connectings where the control means is responsive to pressure sensors at connected suction ports, and the discharge sequence and the suction sequence take place concurrently and are of the same duration.

Some forms of this invention also comprise a compressor capacity shut-off means and a shut-off control means responsive to a pressure sensor and comparator at a connected controlling selector valve port. The operation of these shut-off equipped forms of this invention is similar to the operation described above for multipressure compressors without shut-off equipment except as follows:

1. compressor capacity is shut off to zero when the pressure at the connected controlling selector valve port reaches the set value for that port;
2. compressor capacity is shut off to zero when the controlling selector valve port being connected into is already at its set value of pressure;
3. the shut-off controlling selector valve port will be the connected discharge port where only a discharge selector valve is used, and will be the connected discharge port where both a discharge selector valve and a suction selector valve are used with a common drive means whose control is responsive to the connected discharge port pressure sensor;
4. the shut-off controlling selector valve port will be the connected suction port where only a suction selector valve is used, and will be the connected suction port where both a suction selector valve and a discharge selector valve are used with a common drive means whose control is responsive to the connected suction port pressure sensor;

5. the shut-off controlling selector valve port can be both the connected suction port and the connected discharge port where both a suction selector valve and a discharge selector valve are used with a common drive means whose control is responsive to both the connected suction port pressure sensor and the discharge port pressure sensor;

6. the shut-off controlling selector valve port can be the connected discharge port or the connected suction port or both connected ports where both a discharge selector valve and a suction selector valve are used with independent drive means and control means for each selector valve.

In these ways those forms of this invention also comprising a compressor capacity shut-off means and a control means therefor can operate at essentially zero compressor capacity for a varying proportion of the operating time. For example, when all ports are at their set value pressure, the compressor is at zero capacity all the time, whereas when all ports are away from their set value pressure, the compressor is at full capacity essentially all the time. In this way, these shut-off forms of this invention automatically adjust compressor capacity to equal the desired through flow rate of the gas or vapor being compressed.

Figure 1:
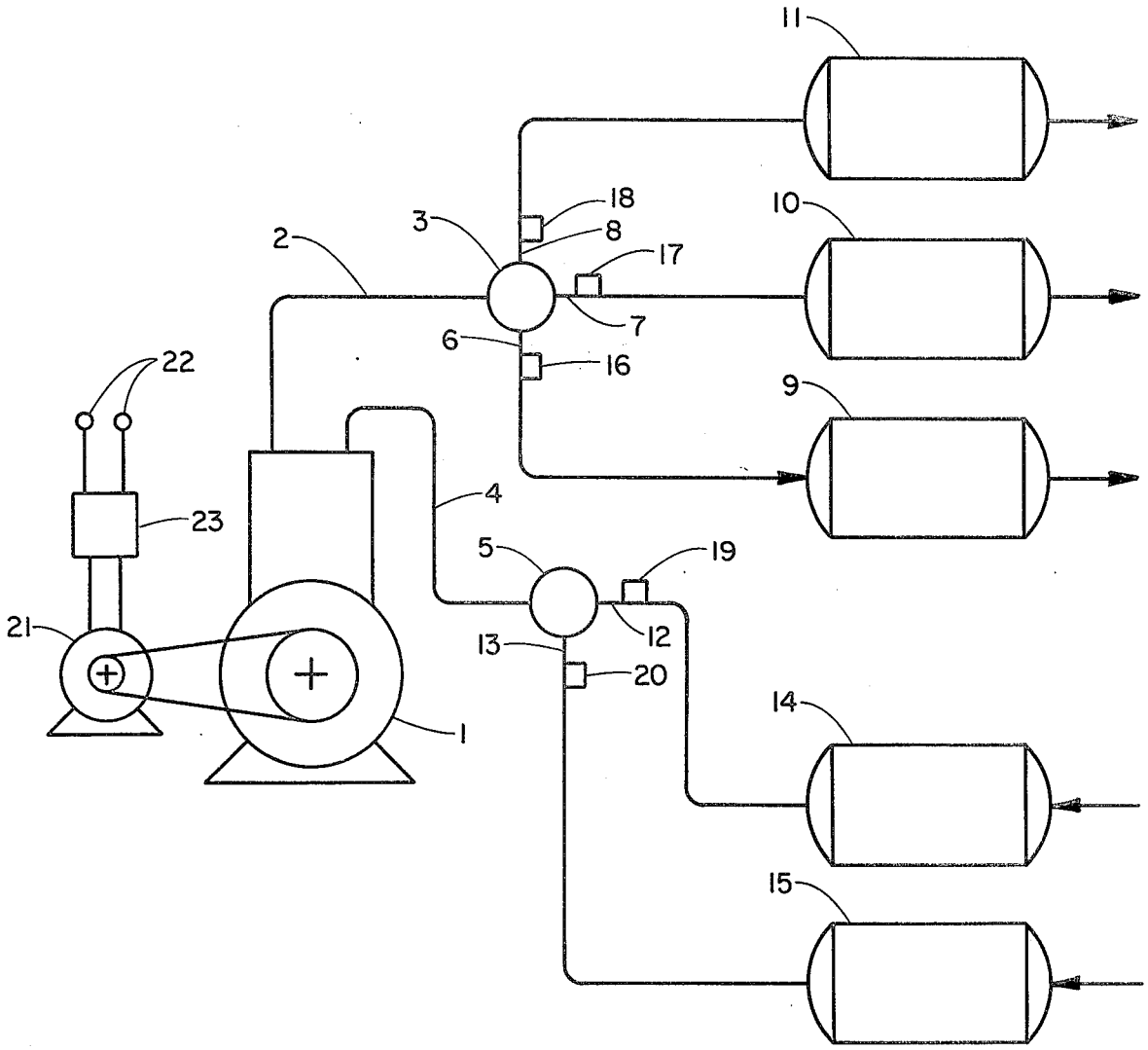

An illustrative example of a multipressure compressor of this invention is shown schematically in FIG. 1 and comprises a compressor, 1, whose discharge pipe, 2, connects to the discharge selector valve, 3, and whose suction pipe, 4, connects to the suction selector valve, 5. The discharge selector valve, 3, has three discharge ports, 6, 7, 8, connected to the three receiver tanks, 9, 10, 11, and the suction selector valve, 5, has two suction ports, 12, 13, connected to the two source tanks, 14, 15. Port pressure sensors, 16, 17, 18, 19, 20, act via a control scheme to initiate the selector valve drive means, which latter is not shown in FIG. 1. For this particular example, the discharge selector valve, 3, and the suction selector valve, 5, each have their own separate drive means and control means. As shown in FIG. 1, the receiver tanks, 9, 10, 11, have a net outflow of gas or vapor, apart from any flow received from the compressor, 1, via the discharge selector valve, 3. Also as shown on FIG. 1 the source tanks, 14, 15, have a net inflow of gas or vapor apart from any flow to the compressor, 1, via the suction selector valve, 5. The electric motor, 21, receiving power via the power source, 22, and switch, 23, drives the compressor, 1.

The operation of the FIG. 1 form of this invention can be described as follows when the drive motor, 21, and compressor, 1, are running. With the compressor suction, 4, connected to port, 13, and source tank, 15, the pressure drops in this tank until the set minimum value is reached at which point the port pressure sensor, 20, actuates the suction selector valve control means and drive means and switches the selector valve, 5, to connect to port, 12, and source tank, 14. This source selection process is repeated when tank, 14, reaches its set value of minimum pressure and the sequence of suction connectings recommences at port, 13. With the compressor discharge, 2, connected to the discharge port, 6, and receiver tank, 9, the pressure rises in this tank until the set maximum value is reached at which point the port pressure sensor, 16, actuates the discharge selector valve control and drive means and switches the selector valve, 3, to connect to port, 7, and receiver tank, 10. This receiver selection process is repeated when port, 7, and tank, 10, reaches its set value of maximum pressure and again, when port, 8, and tank, 11, reaches its set value of maximum pressure, after which this sequence of discharge connectings recommences at port, 6, and tank, 9. For this described sequence, it is preferable that pressures in tank, 14, be greater than in tank, 15, and that pressures increase in the receiver tanks in the order, tank, 9, tank, 10, tank 11.

Figure 2:
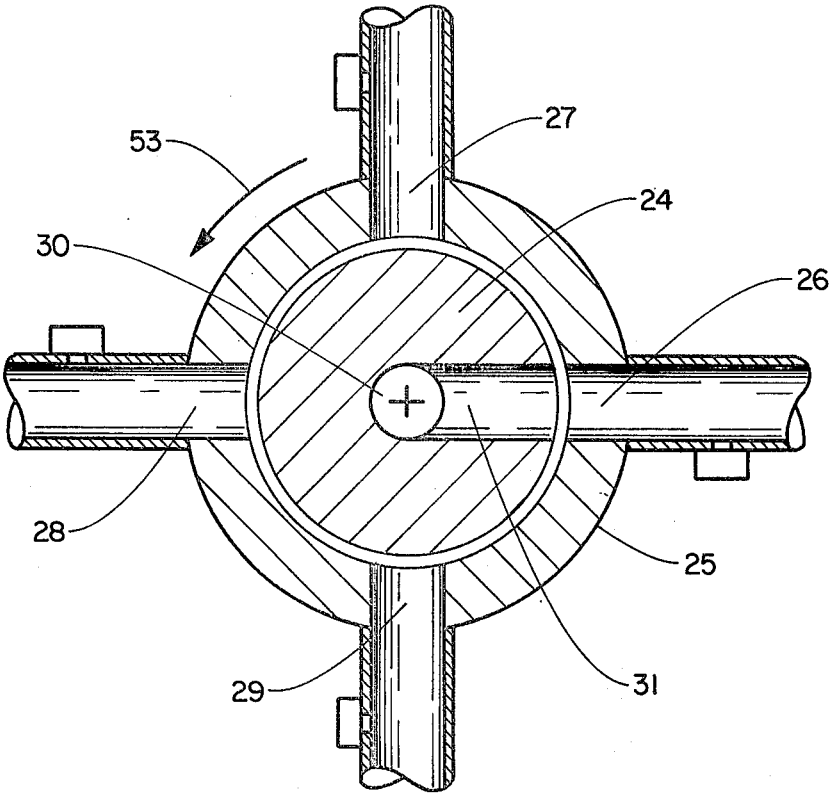

One particular example of a selector valve is shown in FIG. 2 of a rotary type, comprising a moving valve element, 24, rotating sealably inside a stationary housing, 25, fitted with ports, 26, 27, 28, 29. The moving valve element, 24, connects via its inlet port, 30, always to the compressor, 1, and via its moving port, 31, to the ports, 26, 27, 28, 29, one port at a time in a sequence of connectings. The moving port, 31, can be thusly moved through the sequence of connectings by various kinds of valve drive means and control means of which one particular example is shown in FIGS. 3, 4, 5, and 6. The ratchet wheel, 32, of FIG. 3 is connected to and drives the moving valve element, 24, directly and is itself rotated by the moving pawl, 33, of the oscillating member, 34, and prevented from back rotating by the fixed pawl, 35. The oscillating member, 34, is rotated back and forth through an arc of ninety degrees about the centerline of rotation, 36, of the ratchet wheel, 32, by the bar, 37. An example of an electrical drive for moving the bar, 37, is shown schematically in FIG. 4 and comprises a solenoid, 38, which moves the bar, 37, in the direction, 39, when energized, and a spring, 40, which moves the bar, 37, in the direction, 41, when the solenoid is not energized, this being the desired back and forth drive motion for the oscillating member, 34, in FIG. 3. The solenoid, 38, is energized via a control means comprising the power source, 42, the cam switch, 43, the pressure sensor and comparator switch, 44, whose pressure connection is to a port, 28, of the selector valve, and the paired single pole double throw switches, 51, 52. As shown in FIG. 4, the port, 28, is changing in pressure since it is connected to the compressor via the selector valve moving element 24, and moving port, 31, and the pressure switch, 44, is open since port pressure is not at set value. The cam switch, 43, and the paired switches, 51, 52, are closed and the solenoid is not energized. When the pressure at the port, 28, reaches its set value, the pressure sensor switch, 44, is closed and the solenoid, 38, is energized, thus causing the bar, 37, to move and the oscillating member, 34, the ratchet wheel, 32, and the moving valve element, 24, rotate ninety degrees, thus indexing the moving port, 31, to the next selector valve port and thus also disconnecting the port, 28, from the compressor. This rotation motion also opens the cam switch, 43, and closes the next cam switch, 46, as is shown schematically in FIG. 6 so that the compressor now connects to the next port in the sequence. The switch cam, 49, is integral with the ratchet wheel, 32, and rotates with it about the centerline, 36. The lifter section, 50, of the switch cam, 49, closes whichever of the cam switches, 43, 46, 47, 48, it is engaged with and, when rotated through ninety degrees disengages from the preceding cam switch, 43, and engages with the next cam switch, 46. Each of the cam switches, 43, 46, 47, 48, connects to one side of the power source, 42, and connects also to one pressure sensor switch at the appropriate port as shown, for example, in FIG. 4. The motion of the bar, 37, in the direction, 39, when the solenoid, 38, is energized also trips one of the paired switches, 52, at the end of travel thus opening the solenoid circuit and deenergizing the solenoid. The spring, 40, then moves the bar, 37, back in the direction, 41, and trips the other one of the paired switches, 51, at the opposite end of travel, thus closing that portion of the solenoid circuit again. The paired switches, 51, 52, are wired as shown in FIG. 5 so that whenever switch 52 is tripped, the circuit is opened and whenever switch 51 is tripped, the circuit is closed, and these switches assure that the bar, 37, makes a full stroke of motion in both directions, 39, 41, each time a connected pressure sensor switch closes. In this way, the compressor connection, 30, is connected, in turn, to the four different selector valve ports, 28, 29, 26, 27, and in that sequence for the direction of motion, 53, of the selector valve moving element, 24, and this constitutes a sequence of selector valve connectings, with each port reaching its set pressure once during each sequence before being disconnected from the compressor. This sequence of connectings of the selector valve is continually repeated whenever the compressor is operating.

Also shown in FIG. 4 is an example compressor shut-off means whose control means is the same as the electrical control means for the drive means shown in FIG. 4. This shut-off means comprises a solenoid, 54, which when energized opens a bypass valve, 55, between the compressor discharge, 56, and the compressor suction, 57, thus reducing the compressor capacity to essentially zero. When the solenoid, 54, is not energized the spring, 58, closes the bypass valve, 55, and directs the compressor discharge into a compressor discharge pipe, 59, which may connect to a discharge selector valve. Note that the solenoid, 54, of the shut-off means is energized concurrently with the solenoid, 38, of the selector valve drive means and by the same control means comprising the pressure sensor switches, the cam switches and the paired switches and their actuator. Of course, a separate shut-off control means could alternatively be used if desired. Hence, compressor capacity is reduced to essentially zero whenever the pressure at the controlling connected selector valve port reaches the set value for that port and also whenever the pressure at the controlling selector valve port being connected into is already at its set value.

An example of a pneumatic selector valve drive means and control means therefor is shown schematically in FIG. 7 for use with the selector valve of FIG. 2 and the ratchet drive of FIG. 3 and comprising a pneumatic piston, 60, cylinder, 61, and spring, 62, actuator portion of a selector valve drive means, a piston, cylinder, and spring pressure sensor and comparator, 63, a cam actuated on-off valve, 64, a flow restrictor, 65, a reserve volume tank, 66, a shuttle valve, 67, and shuttle valve actuator, 68. The pressure sensor and comparator, 63, connects via the pipe, 69, to one selector valve port, via the pipe, 70, to atmosphere, via the pipe, 71, to the cam actuated on-off valve, 64, and via the pipe, 72, to a source of high pressure pneumatic control gas. The cam, 73, acts upon the on-off valve 64, to connect pipe, 71, to pipe, 74, whenever the selector valve port to which the pressure sensor and comparator, 63, is connected is connected into by the selector valve moving element. The cam, 73, is thus connected to and rotates directly with the selector valve moving element as, 24, in FIG. 2. Each selector valve port is equipped with similar but separate pressure sensor and comparator elements and cam actuated on-off valves but the cam, 73, can function for all of the on-off valves. While the thusly connected port is below set value pressure, the comparator spring, 75, holds the piston, 76, so that the pipe, 71, is vented to atmosphere via pipe, 70. Hence the actuator piston, 60, and connected bar, 37, are pressed by the spring, 62, in the direction, 41, and the shuttle valve, 67, is pressed by the actuator, 68, to connect pipe, 77, to pipe, 78, and hence to pipe, 74, via restrictor, 65, pipe, 74, being in turn connected to pipe, 71, via the now open on-off valve, 64. When the pressure at the connected port reaches the set value for that port, the piston, 76, is forced against the spring, 75, sufficiently to close off vent pipe, 70, and open into high pressure pipe, 72. The high pressure pneumatic gas from pipe, 72, then acts to force the actuator piston, 60, and hence the bar, 37, in the direction, 39, which rotates the selector valve moving element, 24, and the cam, 73, through a 90 degree arc as via the FIG. 3 scheme. The next selector valve port in the sequence is thus connected into and its cam actuated on-off valve is then opened thusly connecting its pressure sensor and comparator into pipe, 74. Concurrently, the cam actuated on-off valve, 64, for the original pressure sensor and comparator, 63, is closed, thus disconnecting original pressure sensor, 63, from the pipe, 74. Also concurrently with the last portion of the stroke of the piston, 60, in the direction, 39, the shuttle valve actuator, 68, moves the shuttle valve to vent the pipe, 77, to atmosphere via the vent, 79, thus causing the spring, 62, to move the piston, 60, and bar, 37, back in the direction, 41, and at the last portion of the stroke of the piston, 60, in this direction the shuttle value actuator, 68, moves the shuttle valve to connect the pipe, 77, to the pipe, 78. The drive means and control means are thus returned to their original condition, except that the next selector valve port in the sequence is now connected into, and the above process will repeat when this new port reaches its set value of pressure. The selector valve sequence of connectings is thusly carried out and continually repeated with each port reaching its set value of pressure once during each sequence. The pressure sensor and comparator, 63, shown in FIG. 7 is arranged as a discharge pressure sensor but similar piston, cylinder and spring sensors and comparators can also be arranged for use as suction pressure sensors.

Also shown in FIG. 7 is an example compressor shut-off means whose control means is the same pneumatic control means for the drive means shown in FIG. 7. This shut-off means comprises a piston, 80, cylinder, 81, and spring, 82, shut-off whose bar, 83, holds the compressor suction valve, 84, open whenever the pneumatic pressure from pipe, 72, is applied via the sensor, 63, the on-off valve, 64, to the piston, 80. The spring, 82, holds the bar, 83, away from the compressor suction valve, 84, and thus the suction valve is free to operate normally, whenever the connected pressure sensor, 63, is venting the pipes, 71, 74, to atmosphere via the vent pipe, 70. Hence, the compressor operates at full capacity, with the suction valve free, until the connected port reaches its set value of pressure at which time the compressor suction valve is held open and this reduces the compressor capacity to essentially zero. Also when the selector valve port being connected into is already at set value pressure, the high pressure pneumatic gas will be applied to the piston, 80, and the compressor capacity will remain at zero since the then connected sensor will have closed the vent pipe and opened the high pressure gas pipe.

The restrictor, 65, and reserve tank, 66, assure that the piston, 60, and bar, 37, will make a full stroke in the direction, 39, even though the pressure in the pipe, 74, may drop to atmospheric when this stroke rotates the cam, 73, to open the next on-off valve and connect pipe, 74, to the next pressure sensor and comparator.

The threaded spring end bell, 99, can be used to adjust the precompression of the spring, 75, and thus to adjust the set value of pressure to which the pressure sensor and comparator, 63, operates.

An example of an electrical selector valve drive means and an electronic control means is shown schematically in FIG. 8 and comprises solenoid valves, 85, 86, 87, 88, equal in number to the selector valve ports, 89, 90, 91, 92, electrical pressure sensors, 93, 94, 95, 96, one at each port, an electronic controller, 97. The pipe, 98, connects to the compressor, either suction or discharge, and to each of the solenoid valves, 85, 86, 87, 88. The electronic controller, 97, receives as input the pressure sensor signals from the sensors, 93, 94, 95, 96, and delivers as output solenoid energizer power to one solenoid valve at a time in a sequence so that each of the solenoid valves, 85, 86, 87, 88, is opened once during each sequence, all other solenoid valves being then closed. The sequence in which the solenoid valves, 85, 86, 87, 88, are opened is preset into the electronic controller, 97, but different sequences can be used by changing this preset of the controller. When one particular solenoid valve, say, 85, is open the compressor is then pumping only at that connected port, 89, and when in consequence of this pumping the pressure at that port reaches the set value for that port, the pressure sensor signal from, 93, is compared by the controller, 97, against the set value for that port which being now reached the controller closes the solenoid valve, 85, and simultaneously opens the next solenoid valve in the preset sequence, say, 88, and thus the compressor then starts pumping at the then connected port, 92. In this manner, the full sequence of connectings is carried out and repeated continually, and each port is brought to its set value of pressure once during each sequence. The adjustment knobs, 100, 101, 102, 103, can adjust the set value of pressure for the selector valve ports, 89, 90, 91, 92, respectively.

Also shown in FIG. 8 is an example compressor shut-off means wherein the controller has an additional output to the power switch, 23, of the compressor drive motor, 21. Whenever the connected selector valve port reaches, or is at set pressure, the controller turns off the switch, 23, and the compressor drive motor and the compressor stop, thus reducing compressor capacity to zero.

A special, cascade form of this invention is shown in a schematic example in FIG. 9 wherein the compressor discharge pipe, 2, of the compressor, 1, is connected to the inlet port of a discharge selector valve, 3, and the compressor suction pipe, 4, is connected to the inlet port of a suction selector valve, 5. The discharge selector valve, 3, and the suction selector valve, 5, are driven simultaneously by a common selector valve drive means, 104, which is actuated by a common control means, 105. The number of discharge ports, 106, 107, 108, equals the number of suction ports, 109, 110, 111, and the discharge sequence of connectings occurs concurrently with the suction sequence of connectings. For the particular example of FIG. 9, the discharge sequence of connectings occurs in the order of ports, 106, 107, 108, and the suction sequence of connectings occurs in the order of ports, 109, 110, 111. The following pairs of ports are thus connected simultaneously: 106 with 109; 107 with 110; 108 with 111. The FIG. 9 form of this invention additionally comprises a crossover connecting pipe, 112, between ports, 106, and, 110, and a crossover connecting pipe, 113, between ports, 107, and, 111, and thus these ports thusly crossover connected are common ports to both the discharge selector valve and the suction selector valve. In consequence, the suction sequence of connectings commences with that one suction port, 109, which does not have a crossover connection and connects next to that common port, 110, 106, at which the discharge sequence commenced, and proceeds thereafter during the suction sequence to connect to each common port next after that common port is connected to in the discharge sequence, and the discharge sequence ends with that one discharge port, 108, which does not have a crossover connection. This suction sequence and this discharge sequence are then repeated continually while the compressor is running. The control means, 105, can be responsive to the pressure sensor and comparator at the connected discharge port, or to the pressure sensor and comparator at the connected suction port, or to both.

Also shown in FIG. 9 is the application of this cascade form of this invention to an example case wherein gas or vapor is to be compressed from a source, 114, through a large pressure range to a receiver, 115, the pressure range being sufficient that a multistage compressor would normally be used. The cascaded compressor, 1, pumps first from the source tank, 116, into the intermediate tank, 117, via the suction port, 109, and the discharge port, 106, until the pressure at the port, 106, and hence in the tank, 117, reaches its set value. During the next step in the sequence, the compressor pumps from the intermediate tank, 117, into the intermediate tank, 118, via the suction port, 110, and the discharge port, 107, until the pressure at the port, 107, and hence in the tank, 118, reaches its set value. During the last step in the sequence, the compressor pumps from the intermediate tank, 118, into the receiver tank, 119, via the suction port, 111, and the discharge port, 108, until the pressure at the port, 108, and hence in the receiver tank, 119, reaches its set value. Thereafter, the above-described sequence of connectings is repeated with the beneficial result that the single compressor, 1, pumps gas or vapor through a large range of pressure normally requiring the use of a multistage compressor.

Various types of compressor shut-off means and control means therefor can be used with the cascade form of this invention, such as those described hereinabove, provided that the shut-off control means must be responsive to the same pressure sensors and comparators as is the selector valve drive control means. This responsiveness requirement avoids the possibility of shutting off the compressor before the drive means can be actuated and thus preventing the sequence of connectings from continuing.

As shown in FIG. 9, the intermediate tanks, 117, 118, are only holding tanks but these intermediate tanks can alternatively be used as source tanks, receiving gas or vapor from outside, or as receiver tanks delivering gas or vapor to outside, or as both. Herein is another beneficial advantage of the machines of this invention over prior art positive displacement multistage compressors, which cannot use the interstage tanks as sources and/or receivers without changing the operating pressures. With a prior art multistage positive displacement compressor, the gas or vapor flow rate between stages, and hence between interstage tanks, is fixed by the piston or displacer displacement. In the machines of this invention, the gas or vapor flow rate between intermediate tanks can be varied over a wide range without changing the pressures by variation of the compressor operating time at each particular position in the sequence.

An example will illustrate how the multipressure compressors of this invention can be used for a home heating system. In the FIG. 1 form of this invention, the gas being compressed could be a Freon refrigerant, and the several tanks, 9, 10, 11, 14, 15, could be heat exchangers used as follows:

a. Tank 11 would be a Freon condenser at high pressure to heat hot water.
b. Tank 10 would be a Freon condenser at high pressure to heat the clothes dryer.
c. Tank 9 would be a Freon condenser at moderate pressure to heat the house air.
d. Tank 14 would be a Freon evaporator at moderate pressure heated from an external source, such as the water mains of a district heating scheme.
e. Tank 15 would be a Freon evaporator at lower pressure to cool the house air.
f. The liquid freon condensed in condenser tanks, 9, 10, 11, would be supplied to evaporator tanks, 14, 15, via suitable expansion valves.

This example serves to illustrate how a single compressor can be used to serve several different purposes which would otherwise require several compressors.

Conventional, prior art, district heating systems are obliged to supply very hot water at high pressure in the heating water mains since direct heat exchangers are used and the high temperatures are necessary for the hot water tank and the clothes dryer. Hence, prior art district heating water mains are costly since they are at high pressure and must be heavily insulated since the water must be kept at a high temperature. Where a multipressure compressor heat pump is used with district heating, as described above, the water in the district heating mains can be at a moderate temperature and low pressure and the mains are thus less expensive than for prior art systems, and this is another beneficial object made available by the machines of this invention.

Where a multipressure compressor heat pump is to be used for heating purposes only, with no cooling load, only a single suction tank is needed and hence the multipressure compressor need only be fitted with a discharge selector valve. Where a multipressure compressor is used with a refrigeration plant, operating at several different refrigeration temperatures and hence several different suction pressures, but with only one high-pressure condenser tank, only a suction selector valve is required.

In all of these example applications, using several different pressures, the devices of this invention permit use of but a single compressor to accommodate these several different pressures whereas in the prior art several different compressors would be required. In this way, the multipressure compressors of this invention make available the beneficial object of reducing the cost of the plant.

The compressor is sized preferably with a maximum capacity, (CFM), in cubic feet per minute, which will compress a mass of gas or vapor per unit of time equal to all needed high pressure flow rates where it is the high pressure gas or vapor which is utilized, or equal to all needed low pressure flow rates where it is the low pressure gas or vapor which is utilized. For positive displacement compressors, the following approximate sizing relations may be used:

$$(CFM)=(NV)(VD)(RPM)$$

Wherein: (NV) is the compressor volumetric efficiency in fractional form; (VD) is the compressor displacement in cubic feet per cycle or revolution; (RPM) is the compressor speed in revolutions or cycles per minute. The compressor may operate at several different suction pressures and hence suction densities, d, and the volumetric efficiency, NV, is frequently variable being dependent upon the pressure ratio at which the compressor operates. Thus, the relation between compressor size as displacement, (VD), and total desired mass flow rate of gas or vapor, (M), in pounds per minute can be estimated from the following relation:

$$(VD) = \frac{(M)}{\text{RPM}} \quad \frac{(T)}{[\text{Sum of } (d)(nv)(t)]}$$

Wherein the [Sum of (d)(nv)(t)] is the sum over a full sequence of compressor operating modes of the product, for each mode of gas suction density, d, in pounds per cubic foot, fractional volumetric efficiency, nv, and operating time in that mode, t, in minutes. The term, T, is the total operating time, in minutes, to carry out a full sequence of compressor operating modes. A conservative compressor sizing procedure is to use only the lowest values of suction density, dmin, and volumetric efficiency, nvmin, and the resulting relation:

$$(VD) = \frac{M}{(\text{RPM})(d\text{min})(nv\text{min})}$$

The compressor drive motor power, G, in horsepower, is equal to the power required to drive the compressor in whatever operating mode has the greatest power requirement. This maximum power requirement can be estimated from the following relation:

$$G = \frac{(VD)(\text{RPM})}{(42.42)} \left\{ \frac{(d)(nv)(h)}{(nc)} \right\}$$

Wherein (h) is the isentropic enthalpy rise across the compressor in BTU per pound of gas or vapor and (nc) is the compressor adiabatic efficiency in fractional form. The quantity $(d)(nv)(h)/_{(nc)}$ is evaluated for each compressor operating mode and its maximum value is used to calculate the maximum required drive motor power, Gmax.

Having thus described my invention, what I claim is:

1. A multipressure compressor machine comprising:

a compressor comprising a suction pipe and a discharge pipe;

means for driving said compressor;

a discharge selector valve comprising, at least two discharge ports, an inlet port, and means for connecting said inlet port to said discharge ports one discharge port at a time;

a connection between said compressor discharge pipe and said discharge selector valve inlet;

drive means for driving said discharge selector valve connecting means through a discharge sequence of connectings between said inlet and said discharge ports so that only one discharge port is connected at any one time, each discharge port is connected at least once during each such discharge sequence of connectings;

means for sensing the pressure of each of said discharge ports and for comparing said sensed pressure against a set value of maximum pressure for that discharge port;

control means responsive to said discharge pressure sensing means at the connected discharge port and operative upon said discharge selector valve drive means so that, whenever said sensed discharge port pressure exceeds said set value of maximum pressure for that connected port, said discharge selector valve drive means is actuated to drive said discharge selector valve on to connect to the next discharge port in said discharge sequence, said discharge sequence of connectings is continuously repeated whenever the machine is running;

a suction selector valve comprising, at least two suction ports, an inlet port, and means for connecting said inlet port to said suction ports, one suction port at a time;

a connection between said compressor suction pipe and said suction selector valve inlet;

drive means for driving said suction selector valve connecting means through a suction sequence of connectings between said inlet and said suction ports so that, only one suction port is connected at any one time, each suction port is connected at least once during each such discharge sequence of connectings;

means for sensing the pressure at each said suction ports and for comparing said sensed pressure against a set value of minimum pressure for that suction port;

control means reponsive to said suction pressure sensing means at the connected suction port and operative upon said suction selector valve drive means so that, whenever said sensed suction port pressure is less than said set value of minimum pressure of that connected port, said suction selector valve drive means is actuated to drive said suction selector valve on to connect to the next suction port in said suction sequence, said suction sequence of connectings is continuously repeated whenever the machine is running.

2. A multipressure compressor machine comprising:

a compressor comprising a suction pipe and a discharge pipe;

means for driving said compressor;

a discharge selector valve comprising, at least two discharge ports, an inlet port, and means for connecting said inlet port to said discharge ports one discharge port at a time;

a connection between said compressor discharge pipe and said discharge selector valve inlet;

drive means for driving said discharge selector valve connecting means through a discharge sequence of connectings between said inlet and said discharge ports so that only one discharge port is connected at any one time, each discharge port is connected only once during each such discharge sequence of connectings;

means for sensing the pressure at each of said discharge ports and for comparing said sensed pressure against a set value of maximum pressure for that discharge port;

control means responsive to said discharge pressure sensing means at the connected discharge port and operative upon said discharge selector valve drive means so that, whenever said sensed discharge port pressure exceeds said set value of maximum pressure for that connected port, said discharge selector valve drive means is actuated to drive said discharge selector valve on to connect to the next discharge port in said discharge sequence, said discharge sequence of connectings is continuously repeated whenever the machine is running;

a suction selector valve comprising suction ports equal in number to said discharge ports, an inlet port, and means for connecting said inlet port to said suction ports one suction port at a time;

a connection between said compressor suction pipe and said suction selector valve inlet;

drive means for driving said suction selector valve connecting means from said discharge selector valve drive means through a suction sequence of connectings between said suction selector valve inlet and said suction ports so that, only one suction port is connected at any one time, each suction port is connected only once during each such suction sequence of connectings, said suction selector valve connecting means is driven on to connect to the next suction port in said suction sequence simultaneously with said driving of said discharge selector valve connecting means on to connect to the next discharge port in said discharge sequence, said suction sequence of connectings is continuously repeated whenever the machine is running.

3. A multipressure compressor machine as described in claim 2;

wherein said discharge selector valve comprises at least three discharge ports;

and further comprising:

crossover connecting means for connecting each one of said discharge ports, except one, to one of said suction ports so that, each suction port, except one, is crossover connected to one of said discharge ports and said crossover connected ports are common ports;

and wherein said control means operates upon said selector valve drive means so that, said suction sequence of connectings commences with that one suction port which does not have a crossover connection and connects next to that common port at which said discharge sequence commenced, and proceeds thereafter, during each said suction sequence, to connect to each said common port next after said each common port is connected to in said discharge sequence, said discharge sequence of connectings ends with that one discharge port which does not have a crossover connection, said discharge sequence of connectings and said suction sequence of connectings are continuously repeated whenever the machine is running.

4. A multipressure compressor machine comprising:

a compressor comprising a suction pipe and a discharge pipe;

means for driving said compressor;

a discharge selector valve comprising, at least two discharge ports, an inlet port, and means for connecting said inlet port to said discharge ports one discharge at a time;

a connection between said compressor discharge pipe and said discharge selector valve inlet;

drive means for driving said discharge selector valve connecting means through a discharge sequence of connectings between said inlet and said discharge ports so that only one discharge port is connected at any one time, each discharge port is connected only once during each such discharge sequence of connectings;

means for sensing the pressure at each of said discharge ports and for comparing said sensed pressure against a set value of maximum pressure for that discharge port;

control means responsive to said discharge pressure sensing means at the connected discharge port and operative upon said discharge selector valve drive means so that, whenever said sensed discharge port pressure exceeds said set value of maximum pressure for that connected port, said discharge selector valve drive means is actuated to drive said discharge selector valve on to connect to the next discharge port in said discharge sequence, said discharge sequence of connectings is continuously repeated whenever the machine is running;

a suction selector valve comprising suction ports equal to number to said discharge ports, an inlet port, and means for connecting said inlet port to said suction ports one suction port at a time;

a connection between said compressor suction pipe and said suction selector valve inlet;

drive means for driving said suction selector valve connecting means from said discharge selector valve drive means through a suction sequence of connectings between said suction selector valve inlet and said suction ports so that, only one suction port is connected at any one time, each suction port is connected only once during each such suction sequence of connectings, said suction selector valve connecting means is driven on to connect to the next suction port in said suction sequence simultaneosly with said driving of said discharge selector valve connecting means on to connect to the next discharge port in said discharge sequence, said suction sequence of connectings is continuously repeated whenever the machine is running;

means for sensing the pressure at each of said suction ports and for comparing said sensed pressure against a set value of minimum pressure for that port;

and further wherein said control means is additionally responsive to said suction pressure sensing means at the connected suction port and is operative upon said discharge selector valve drive means so that, whenever said sensed suction port pressure is less than said set value of minimum pressure for that connected port, or whenever said sensed discharge port pressure exceeds said set value of maximum pressure for that connected port, said discharge selector valve drive means is actuated to simultaneously drive said discharge selector valve on to the next discharge port in said discharge sequence and drive said suction selector valve on to the next suction port in said suction sequence.

5. A multipressure compressor machine as described in claim 4;

wherein said discharge selector valve comprises at least three discharge ports;

and further comprising:

crossover connecting means for connecting each one of said discharge ports, except one, to one of said suction ports so that, each suction port, except one, is crossover connected to one of said discharge ports and said crossover connected ports are common ports;

and wherein said control means operates upon said selector valve drive means so that, said suction sequence of connectings commences with that one suction port which does not have a crossover connection and connects next to that common port at which said discharge sequence commenced, and proceeds thereafter, during each said suction sequence, to connect to each said common port next after said each common port is connected to in said discharge sequence, said discharge sequence of connections ends with that one discharge port which does not have a crossover connection, said discharge sequence of connectings and said suction sequence of connectings are continuously repeated whenever the machine is running.

6. A multipressure compressor machine comprising:

a compressor comprising a suction pipe and a discharge pipe;

means for driving said compressor;

a suction selector valve comprising, at least two suction ports, an inlet port, and means for connecting said inlet port to said suction ports one suction port at a time;

a connection between said compressor suction pipe and said suction selector valve inlet port;

drive means for driving said suction selector valve connecting means through a suction sequence of connectings between said inlet and said suction ports so that, only one suction port is connected at any one time, each suction port is connected at least once during each such discharge sequence of connectings;

means for sensing the pressure at each of said suction ports and for comparing said sensed pressure against a set value of minimum pressure for that suction port;

control means responsive to said suction pressure sensing means at the connected suction port and operative upon said suction selector valve drive means so that, whenever said sensed suction port pressure is less than said set value of minimum pressure for that connected port, said suction selector valve drive means is actuated to drive said suction selector valve on to connect to the next suction port in said suction sequence, said suction sequence of connectings in continuously repeated whenever the machine is running.

7. A multipressure compressor machine as described in claim 5 wherein said suction selector valve drive means drives said suction selector valve connecting means so that each suction port is connected only once during each such suction sequence of connectings;

and further comprising:

a discharge selector valve comprising discharge ports equal in number to said suction ports, an inlet port, and means for connecting said inlet port to said discharge ports one discharge port at a time;

a connection between said compressor discharge pipe and said discharge selector valve inlet;

drive means for driving said discharge selector valve connecting means from said suction selector valve drive means through a discharge sequence of connectings between said discharge selector valve inlet and said discharge ports so that, only one discharge port is connected at any one time, each discharge port is connected only once during each such discharge sequence of connectings, said discharge selector valve connecting means is driven on to connect to the next discharge port in said discharge sequence simultaneously with said driving of said suction selector valve connecting means on to connect to the next suction port in said suction sequence, said discharge sequence of connectings is continuously repeated whenever the machine is running.

8. A multipressure compressor machine as described in claim 7:

wherein said discharge selector valve comprises at least three discharge ports;

and further comprising:

crossover connecting means for connecting each one of said discharge ports, except one, to one of said suction ports so that, each suction port, except one, is crossover connected to one of said discharge ports and said crossover connected ports are common ports;

and wherein said control means operates upon said selector valve drive means so that, said suction sequence of connectings commences with that one suction port which does not have a crossover connection and connects next to that common port at which said discharge sequence commenced, and proceeds thereafter, during each said suction sequence, to connect to each said common port next after said each common port is connected to in said discharge sequence, said discharge sequence of connectings ends with that one discharge port which does not have a crossover connection, said discharge sequence of connectings and said suction sequence of connectings are continuously repeated whenever the machine is running.

9. A multipressure compressor machine as described in claim 1, 2 or 3:

and further comprising:

shut-off means for shutting off the pumping capacity of said compressor to essentially zero capacity;

control means reponsive to said discharge pressure sensing means and operative upon said compressor shut-off means so that, whenever said sensed discharge port pressure exceeds said set value of maximum pressure for that connected port, compressor capacity is shut off to essentially zero.

10. A multipressure compressor machine as described in claim 1, 6, 7, or 8:

and further comprising:

shut-off means for shutting off the pumping capacity of said compressor to essentially zero capacity;

control means responsive to said suction pressure sensing means and operative upon said compressor shut-off means so that, whenever said sensed suction port pressure is less than said set value of minimum pressure for that connected port, compressor capacity is shut off to essentially zero.

11. A multipressure compressor machine as described in claim 1, 4, or 5:

and further comprising:

shut-off means for shutting off the pumping capacity of said compressor to essentially zero capacity;

control means responsive to said discharge pressure sensing means and to said suction pressure sensing means and operative upon said compressor shut-off means so that whenever said sensed discharge port pressure exceeds said set value of maximum pressure for that connected port, or, whenever said sensed suction port pressure is less than said set value of minimum pressure for that connected port, compressor capacity is shut off to essentially zero.

12. A multipressure compressor machine as described in claim 9:

and further comprising:

means for adjusting the set values of maximum pressure for at least one of said discharge pressure sensing means.

13. A multipressure compressor machine as described in claim 10:

and further comprising:

means for adjusting the set values of minimum pressure for at least one of said suction pressure sensing means.

14. A multipressure machine as described in claim 11:

and further comprising:

means for adjusting the set values of maximum pressure for at least one of said discharge pressure sensing means;

means for adjusting the set values of minimum pressure for at least one of said suction pressure sensing means.

15. A multipressure compressor machine as described in claim 1, 2, or 4:

and further comprising:

means for adjusting the set values of maximum pressure for at least one of said discharge pressure sensing means.

16. A multipressure compressor machine as described in claim 4 or 6:

and further comprising:

means for adjusting the set values of minimum pressure for at least one of said suction pressure sensing means.

17. A multipressure compressor machine as described in claim 4:

and further comprising:

means for adjusting the set values of maximum pressure for at least one of said discharge pressure sensing means;

means for adjusting the set values of minimum pressure for at least one of said suction pressure sensing means.

* * * * *

UNITED STATES PATENT AND TRADEMARK OFFICE

CERTIFICATE OF CORRECTION

PATENT NO. : 4,480,654

DATED : Nov. 6, 1984

INVENTOR(S) : Joseph C. Firey

It is certified that error appears in the above-identified patent and that said Letters Patent is hereby corrected as shown below:

Column 18 line 58, change "5," to, -- 6 --

Signed and Sealed this

*Fourth* Day of *June 1985*

[SEAL]

*Attest:*

DONALD J. QUIGG

*Attesting Officer*

*Acting Commissioner of Patents and Trademarks*